US006336476B1

(12) United States Patent
Nakada et al.

(10) Patent No.: US 6,336,476 B1
(45) Date of Patent: Jan. 8, 2002

(54) METHOD FOR A TUCK-IN SELVEDGE SETTING IN A TUCK-IN DEVICE OF A SHUTTLELESS LOOM FOR TOWELS

(75) Inventors: Akihiko Nakada; Shigeharu Sawada, both of Kanazawa (JP)

(73) Assignee: Tsudakoma Kogyo Kabushiki Kaisha, Kanazawa (JP)

( * ) Notice: Subject to any disclaimer, the term of this patent is extended or adjusted under 35 U.S.C. 154(b) by 0 days.

(21) Appl. No.: 09/744,914

(22) PCT Filed: Dec. 22, 1999

(86) PCT No.: PCT/JP99/07205

§ 371 Date: Jan. 31, 2001

§ 102(e) Date: Jan. 31, 2001

(87) PCT Pub. No.: WO00/73560

PCT Pub. Date: Dec. 7, 2000

(30) Foreign Application Priority Data

Dec. 22, 1999 (JP) ..... 11-151979

(51) Int. Cl.[7] ..... D03D 47/48; D03D 5/00
(52) U.S. Cl. ..... 139/434; 139/25
(58) Field of Search ..... 139/434, 25

(56) References Cited

U.S. PATENT DOCUMENTS 4,078,586 A 3/1978 Porter
4,554,950 A * 11/1985 Sancini et al. ..... 139/25
4,600,039 A 7/1986 Luciano

FOREIGN PATENT DOCUMENTS

| | | | |
|---|---|---|---|
| EP | 626476 | 11/1994 | |
| JP | 1-250446 | * 1/1989 | ..... 139/434 |
| JP | 1-148837 | 6/1989 | |
| JP | 2-053939 | 2/1990 | |

* cited by examiner

*Primary Examiner*—Andy Falik
(74) *Attorney, Agent, or Firm*—Connolly Bove Lodge & Hutz LLP

(57) ABSTRACT

Compared with the method for performing tuck-in operation at each weaving cycle, the method of the present invention makes it possible to increase the number of revolutions of the loom at high speed, to decrease the number of maintenance operations needed for the tuck-in device and to decrease power consumption. Moreover, compared with the method for performing collective tuck-in operation by bringing all wefts inserted into each repeat together, it is possible to improve external appearance of the selvedge of the pile fabric. According to the tuck-in selvedge setting method in a tuck-in device of a shuttleless loom for towel of the present invention, when a pile fabric is woven, tuck-in operations for ends of a plurality of wefts inserted into one repeat for forming a pile fabric are performed by a plurality of times. And in at least one tuck-in operation among these tuck-in operations, ends of a plurality of wefts are collectively brought together, and the last tuck-in operation is carried out in the weaving cycle of a first weft in the next repeat for forming the pile fabric.

3 Claims, 5 Drawing Sheets

METHOD FOR A TUCK-IN SELVEDGE SETTING IN A TUCK-IN DEVICE OF A SHUTTLELESS LOOM FOR TOWELS

TECHNICAL FIELD

The present invention relates to a tuck-in selvedge setting method in a tuck-in device of a shuttleless loom for towels.

BACKGROUND ART

Two methods for tuck-in selvedge setting as described above, are generally known. The first is a method to tuck in at each weaving cycle for both pile fabric and non-pile fabric. According to the second method as described in the Japanese Patent Publication 25018457, in case of a pile fabric, all wefts inserted into one repeat for forming pile fabric are collectively tucked in at the weaving cycle of a first weft in the next repeat for forming the pile fabric. In case of a non-pile fabric, a tuck-in operation is performed at each weaving cycle.

In the first method, it is not possible to increase the number of revolutions of the loom because it is necessary to have enough time for a tuck-in operation at each weaving cycle. Moreover, a tuck-in device is used for each weaving cycle, and this causes severe wearing of the tuck-in device. Further, maintenance must be performed at shorter intervals. Also, power consumption increases because a tuck-in operation is carried out for each weaving cycle. In the second method, the above drawbacks are overcome. On the other hand, at the selvedge of the pile fabric, the tucked portion becomes extremely thick compared with the other portions, and this leads to the disadvantage that external appearance is worsened. In particular, when thicker wefts are used or when more wefts are inserted into one repeat, external appearance is further worsened.

To solve the above problems, it is a first object of the present invention to provide a method, by which it is possible to shorten the time to produce the woven fabric, to decrease the number of maintenance operations needed for the tuck-in device, and to decrease power consumption compared with the method to perform a tuck-in operation for each weaving cycle. Moreover, compared with the method to perform a tuck-in operation collectively for all wefts inserted in each repeat, it is possible to improve external appearance of the selvedge of the pile fabric.

In the second method, when thicker wefts are used as described above, external appearance is extremely worsened. However, in the case of thinner wefts—more concretely, in the case where the yarn has approximate thickness of cotton yarn count 12, such poor appearance becomes relatively inconspicuous. In this respect, the present inventors have found that, when the textile has a portion using thicker wefts and a portion using thinner wefts intermingled with each other, and when it is woven by a series of weaving operations, the second method should be adopted for the portion using thinner wefts and an alternative method modified from the second method should be applied for the portion using thicker wefts to have better external appearance at the selvedge of pile fabric.

It is a second object of the present invention to provide a method by which it is possible, when the textile has a portion using thicker wefts and a portion using thinner wefts intermingled with each other and it is woven, to increase the number of revolutions of the loom at high speed, to have longer maintenance interval for the tuck-in device, and to decrease power consumption compared with the method to perform a tuck-in operation for each weaving cycle regardless of whatever the thickness of the weft may be. Moreover, when thicker wefts are used, it is possible to have better external appearance at the selvedge of pile fabric compared with the method to perform a collective tuck-in operation by bringing all of the wefts inserted into each repeat together.

Further, in the second method as described above, a tuck-in method is different between pile fabric and non-pile fabric, and it is difficult to set proper timing for performing the tuck-in operation. It is a third object of the present invention to provide a method by which it is much easier to set the timing for a tuck-in operation in addition to the above first object.

SUMMARY OF THE INVENTION

According to one aspect of the present invention, a method for tuck-in selvedge setting is provided, which comprises the steps of performing a plurality of tuck-in operations for ends of a plurality of wefts inserted into one repeat to form a pile fabric where a pile fabric is woven, performing at least one tuck-in operation by bringing the ends of a plurality of wefts collectively together, and performing the last tuck-in operation at a weaving cycle of a first weft in the next repeat for forming the pile fabric.

The terms described above are defined as follows: The term "weaving cycle" means a series of operations from one beating to the next beating. The term "one repeat to form pile" is defined as an operation from a beating for forming a pile to a beating for forming the next pile. To explain the procedure of a tuck-in operation more concretely, when three wefts are inserted in one repeat to form a pile, there are two different procedures. The first is the procedure to perform tuck-in operation for two weft ends at first, and then, to perform a tuck-in operation for one weft end. The second is the procedure to perform a tuck-in operation for one weft end at first, and then, to perform tuck-in operation for two weft ends. In the case where there are four wefts, six different procedures are performed. The first is the procedure to perform a tuck-in operation for one weft end during the first time and the second time, and then, to perform a tuck-in operation for two weft ends during the third time. The second is the procedure to perform a tuck-in operation for one weft end during the first time and the third time, and then, to perform a tuck-in operation for two weft ends during the second time. The third is the procedure to perform a tuck-in operation for two weft ends during the first time, and then, to perform a tuck-in operation for one weft end during the second time and the third time. The fourth is the procedure to perform a tuck-in operation for three weft ends during the first time, and then, to perform a tuck-in operation for one weft end during the last time. The fifth is the procedure to perform a tuck-in operation for one weft end during the first time, and then, to perform a tuck-in operation for three weft ends during the last time. The sixth is the procedure to perform a tuck-in operation for two weft ends during the first time and the second time.

According to another aspect of the present invention, the following two methods for a tuck-in selvedge setting are adopted by switching over to each other during a series of weaving operations and by controlling the methods, i.e., a method for a tuck-in selvedge weaving in a tuck-in device of a shuttleless loom for towel when pile fabric is woven, and a method for a tuck-in selvedge setting in a tuck-in device of a shuttleless loom for towels to perform a tuck-in operation for ends of a plurality of wefts inserted into one repeat to form a pile by collectively performing the tuck-in operation in the weaving cycle for the first weft in the repeat to form the next pile.

The term "during a series of weaving operations" is defined as during the time of operation to prepare woven fabric on a take-up roll.

According to still another aspect of the present invention, there is provided a method for a tuck-in selvedge setting in a tuck-in device of a shuttleless loom for towel in a series of weaving operations by combining pile fabric and non-pile fabric, whereby the method for a tuck-in selvedge setting in a tuck-in device of a shuttleless loom for towels is applied when the pile fabric is woven, and a method for a tuck-in selvedge setting in a tuck-in device of a shuttleless loom for towels of the same pattern, as in the process to weave the pile fabric, is applied when the non-pile fabric is woven.

The term "the same pattern" means the following: It is assumed that, during the process to weave the pile fabric, three wefts are inserted into one repeat to form a pile, and a tuck-in operation is performed for two weft ends in the first time. Then, also when a non-pile fabric is woven, a tuck-in operation for two weft ends is performed in the first time, and then, a tuck-in operation is performed for one weft end, and this procedure is repeated.

BEST MODE FOR CARRYING OUT THE INVENTION

Figure 2:
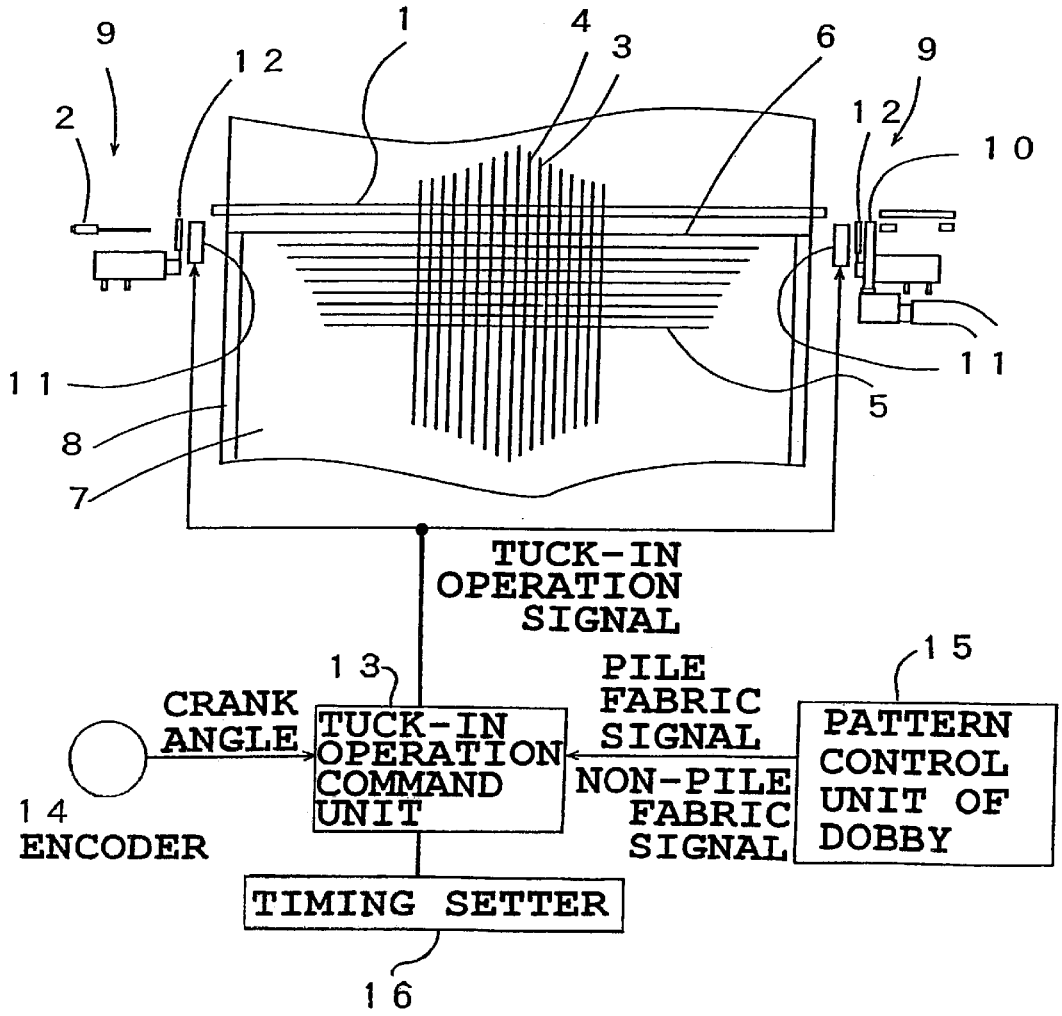
FIG. 2 is a block diagram showing the structure of a tuck-in device of a shuttleless loom for towels used in the present invention.

To facilitate the understanding of the present invention, referring to FIG. 2, a brief description will be given below on the structure of a needleless tuck-in device for gripping and tucking a weft end by pneumatic pressure of an air injection type loom for towels based on a cloth moving system. Reference numeral 1 represents a reed or a yarn guide, 2 a weft inserting nozzle, 3 a ground warp, 4 a pile warp, 5 a weft, 6 a cloth fell, 7 a woven cloth, 8 a selvedge, and 9 a tuck-in selvedge setting device.

In a loom for weaving towels, multiple weaving is generally performed by weaving a plurality of cloth pieces at adjacent positions. Tuck-in selvedge setting device 9 is arranged each at left and right ends of each woven cloth, and it comprises an actuator 11 and a cutter 12. The end of the weft is cut off by the cutter 12 and is tucked into a warp opening by air flow from the actuator 11. On the yarn feeding side, it is necessary to operate the cutter 12 at each weft insertion. On the other parts of the loom, it is operated immediately before the tuck-in operation.

A timing setter 16 sets timing to output a tuck-in operation signal from a tuck-in operation command unit 13 to the actuator 11 for the following two cases: the case where a pile fabric is woven and the case where a non-pile fabric is woven.

The air flow from the actuator 11 is executed according to a tuck-in operation signal outputted from the tuck-in operation command unit 13 to the actuator 11. The time to output the tuck-in operation signal is the time when crank angle, i.e., rotation angle of the crankshaft received from an encoder 14, agrees with the setting condition selected by a pile fabric signal or a non-pile fabric signal received from a pattern control unit 15 of dobby among two setting conditions inputted by the timing setter 16.

Figure 1:
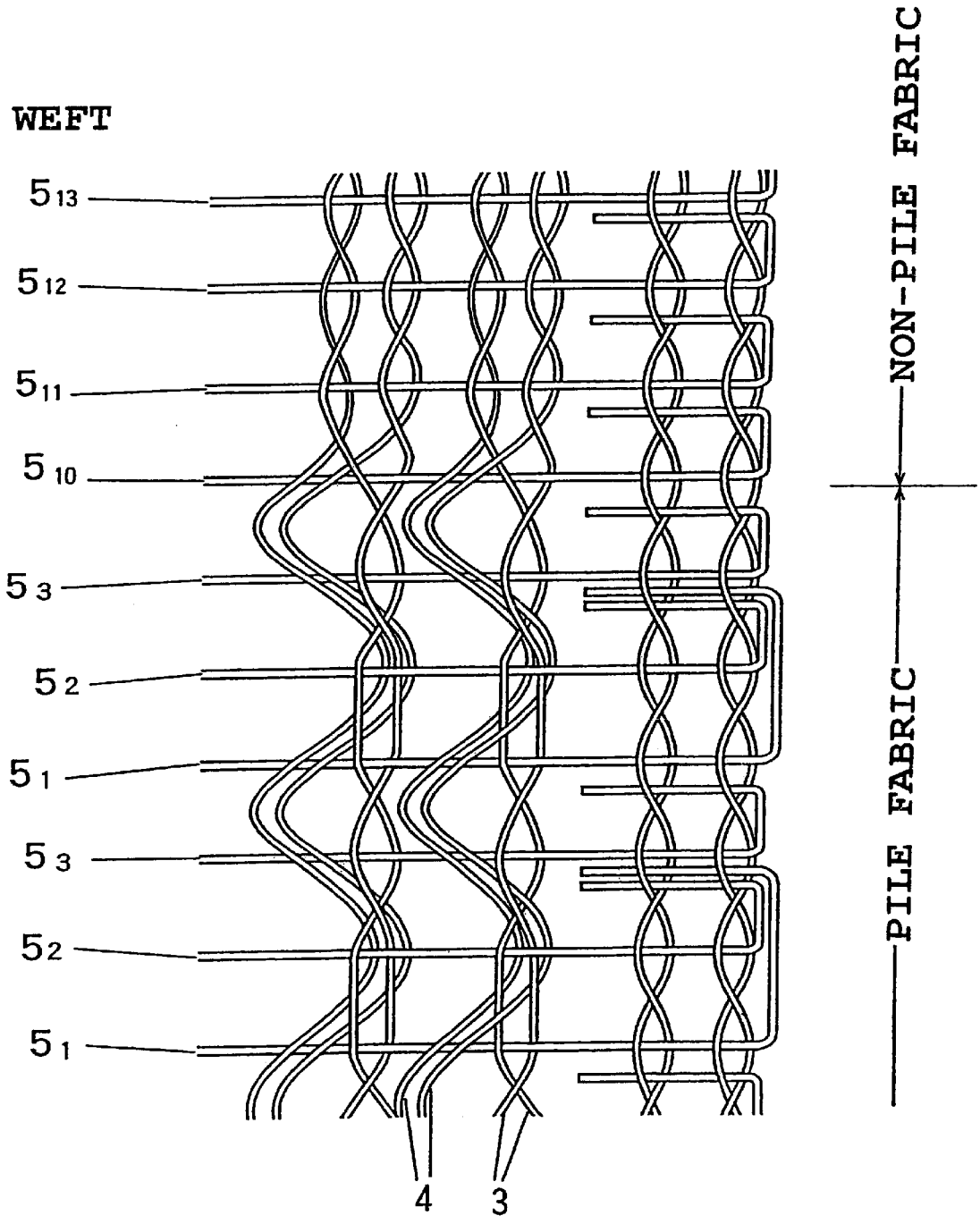
FIG. 1 is a plan view to explain a woven fabric prepared using a first embodiment of the present invention.

Concrete description will be given below on a first embodiment of the present invention referring to FIG. 1. In this case, there are three wefts 5 to be inserted into one repeat to form a pile fabric in case of pile fabric. A first weft $\mathbf{5}_1$ and a second weft $\mathbf{5}_2$ are collectively tucked in, and a third weft $\mathbf{5}_3$ is tucked in alone. In case of non-pile fabric, wefts $\mathbf{5}_{10}$, $\mathbf{5}_{11}$, $\mathbf{5}_{12}$, . . . are tucked in for each weaving cycle.

Detailed description will be given now on the operation of the loom for carrying out the first embodiment by dividing the operation into the operation of pile fabric and the operation of non-pile fabric.

Figure 3:
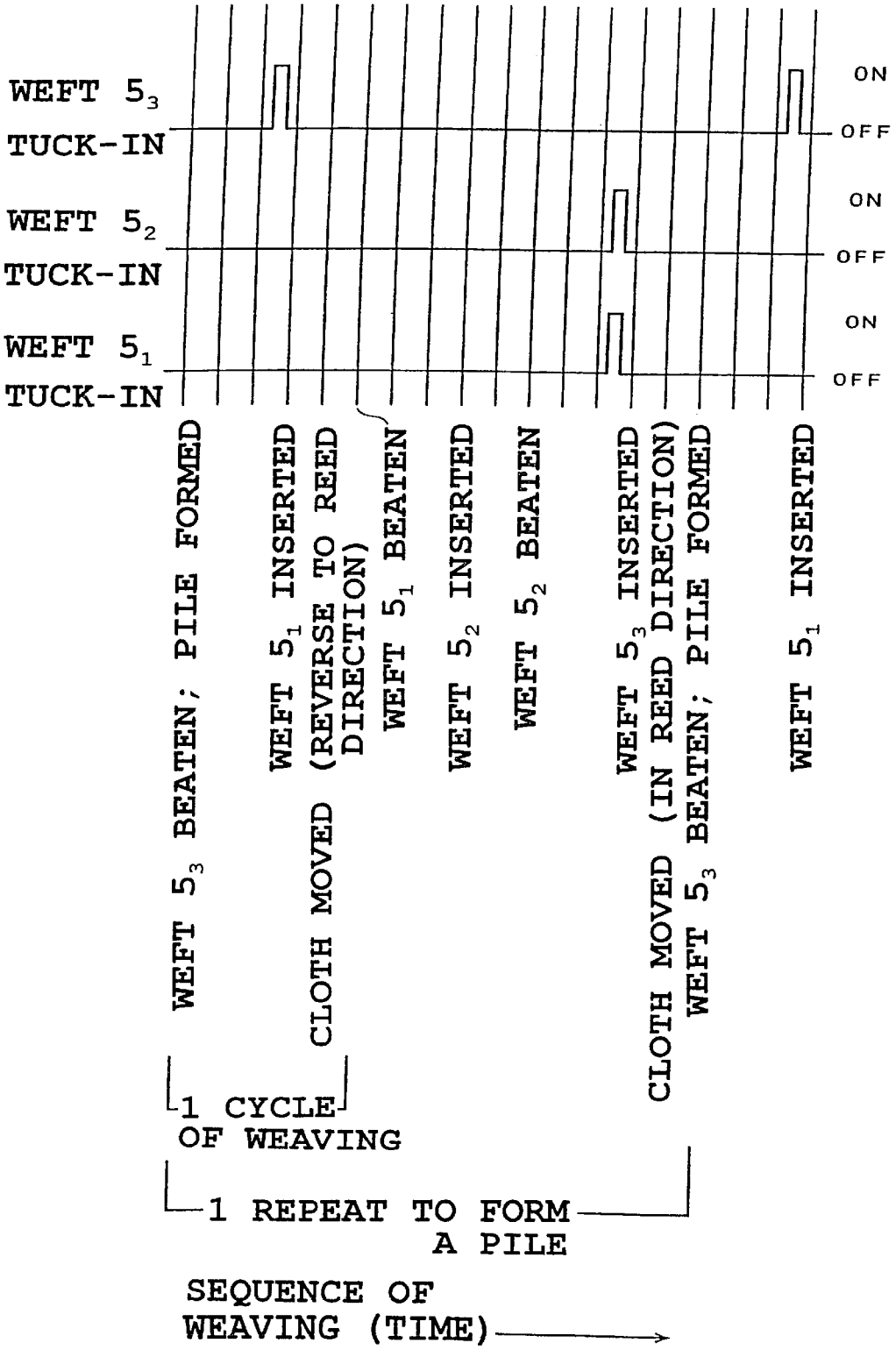
FIG. 3 is a timing chart to indicate the timing of a tuck-in operation of weft when weaving a pile fabric in the above first embodiment.

In the pile fabric, (1) a pile fabric signal is outputted from the pattern control unit 15 of the dobby. (2) As shown in FIG. 3, after the first weft 5 is inserted, the end on yarn feeding side is cut off by the cutter 12, and the yarn end is sucked by the air and is gripped. (3) At the same time as the weft insertion of the first weft $\mathbf{5}_1$, the cloth is moved in a direction reverse to the reed direction, and the first weft $\mathbf{5}_1$ is beaten. Then, the second weft $\mathbf{5}_2$ is inserted, and the end of the yarn feeding side is cut off by the cutter 12, and the yarn end is sucked by the air and is gripped. (4) After beating the second weft $\mathbf{5}_2$, when a crank angle signal inputted from the encoder 14 reaches a preset value, a tuck-in operation signal is issued from the tuck-in operation command unit 13. The ends on the counter-feeding side of the two wefts $\mathbf{5}_1$ and $\mathbf{5}_2$ are cut off together by the cutter 12. Then, by the air flow from the actuator 11, ends of the wefts $\mathbf{5}_1$ and $\mathbf{5}_2$ on yarn feeding side and on counter-feeding side are inserted into the warp opening, which begins to open for the third weft $\mathbf{5}_3$. After insertion, the air flow is stopped. (5) After the third weft $\mathbf{5}_3$ is inserted, the end on the yarn-feeding side is cut off by the cutter 12, and the yarn end is sucked by the air and is gripped. At the same time as the insertion of the third weft $\mathbf{5}_3$, the cloth is moved in the reed direction, and it is beaten to form a pile fabric, and the tucked fabrics of the first weft $\mathbf{5}_1$ and the second weft $\mathbf{5}_2$ are formed at the selvedge 8. (6) When the crank angle signal reaches the preset value, the tuck-in operation signal is outputted. The end on the counter-feeding side of the third weft $\mathbf{5}_3$ is cut off by the cutter 12. By the air flow from the actuator 11, both ends are inserted into the warp opening, which begins to open for the first weft $\mathbf{5}_1$ of the next repeat. After insertion, the air flow is stopped. (7) At the same time as the procedure of (2) above, after the first weft $\mathbf{5}_1$ has been inserted, the end on the yarn feeding side is cut off by the cutter 12, and the yarn end is sucked by the air and is gripped. (8) At the same time as the insertion of the first weft $\mathbf{5}_1$, the cloth is moved in a direction reverse to the reed direction, and the first weft $\mathbf{5}_1$ is beaten, and the tucked fabric of the third weft $\mathbf{5}_3$ is formed at the selvedge 8. (9) The above procedure is repeated.

In case of a non-pile fabric, (1) a non-pile fabric signal is outputted from the pattern control unit 15 of the dobby. (2) After the weft $\mathbf{5}_{10}$ has been inserted, the end on yarn feeding side is cut off by the cutter 12, and the yarn end is sucked by the air and is gripped. (3) After the weft $\mathbf{5}_{10}$ is beaten, when crank angle reaches the preset value, the tuck-in operation signal from the tuck-in operation command unit 13 is outputted. The end on the counter-feeding side is cut off by the cutter 12. By the air flow from the actuator 11, both ends of the weft $\mathbf{5}_{10}$ are inserted into the warp opening, which begins to open for the next warp $5_{11}$. After insertion, the air flow is stopped. (4) After the next weft $5_{11}$ has been inserted, the end on the yarn feeding side is cut off by the cutter 12, and the yarn end is sucked by the air and is gripped. (5) The weft $5_{11}$ is beaten, and the tucked fabric of the weft $5_{10}$ is formed at the selvedge 8. When the crank angle signal reaches the preset value, the tuck-in operation signal is outputted. (6) The above procedure is repeated.

Now, a detailed description will be given on the second embodiment of the present invention. In the case of a pile fabric, there are three wefts 5 to be inserted into one repeat to form the pile fabric. The method adopted in the first embodiment is applied, i.e. the first weft $5_1$ and the second weft $5_2$ are tucked in together, and the third weft $5_3$ is tucked in alone (hereinafter referred as "divided tuck-in method"), and also there is another method to perform a collective tuck-in operation for three wefts $5_1$, $5_2$ and $5_3$ (hereinafter referred as "collective tuck-in method"). These two methods are used by switching over to each other during a series of weaving operation. In case of a non-pile fabric, the wefts $5_{10}$, $5_{11}$ and $5_{12}$, . . . are tucked in at each weaving cycle.

The divided tuck-in method and the collective tuck-in method can be switched over to each other and performed as follows: A divided tuck-in signal for pile fabric or a collective tuck-in signal for pile fabric is issued from the pattern control unit 15 of the dobby to the tuck-in operation command unit 13. When the divided tuck-in signal for pile fabric is outputted, the divided tuck-in method is carried out. When the collective tuck-in signal for pile fabric is issued, the collective tuck-in method is performed.

Figure 4:
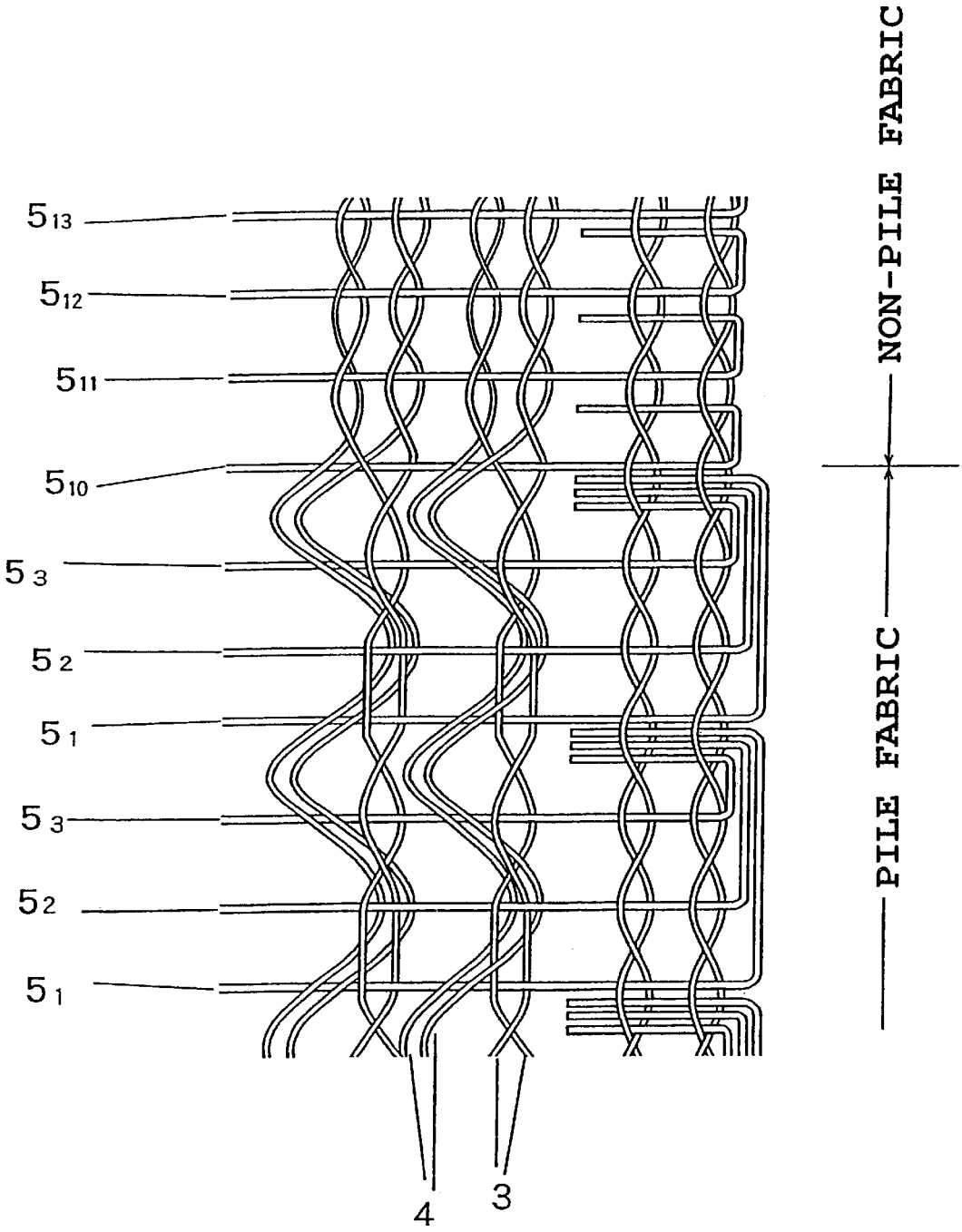
FIG. 4 is a plan view to explain a woven fabric prepared by a collective tuck-in method used in a second embodiment of the present invention.
Figure 5:
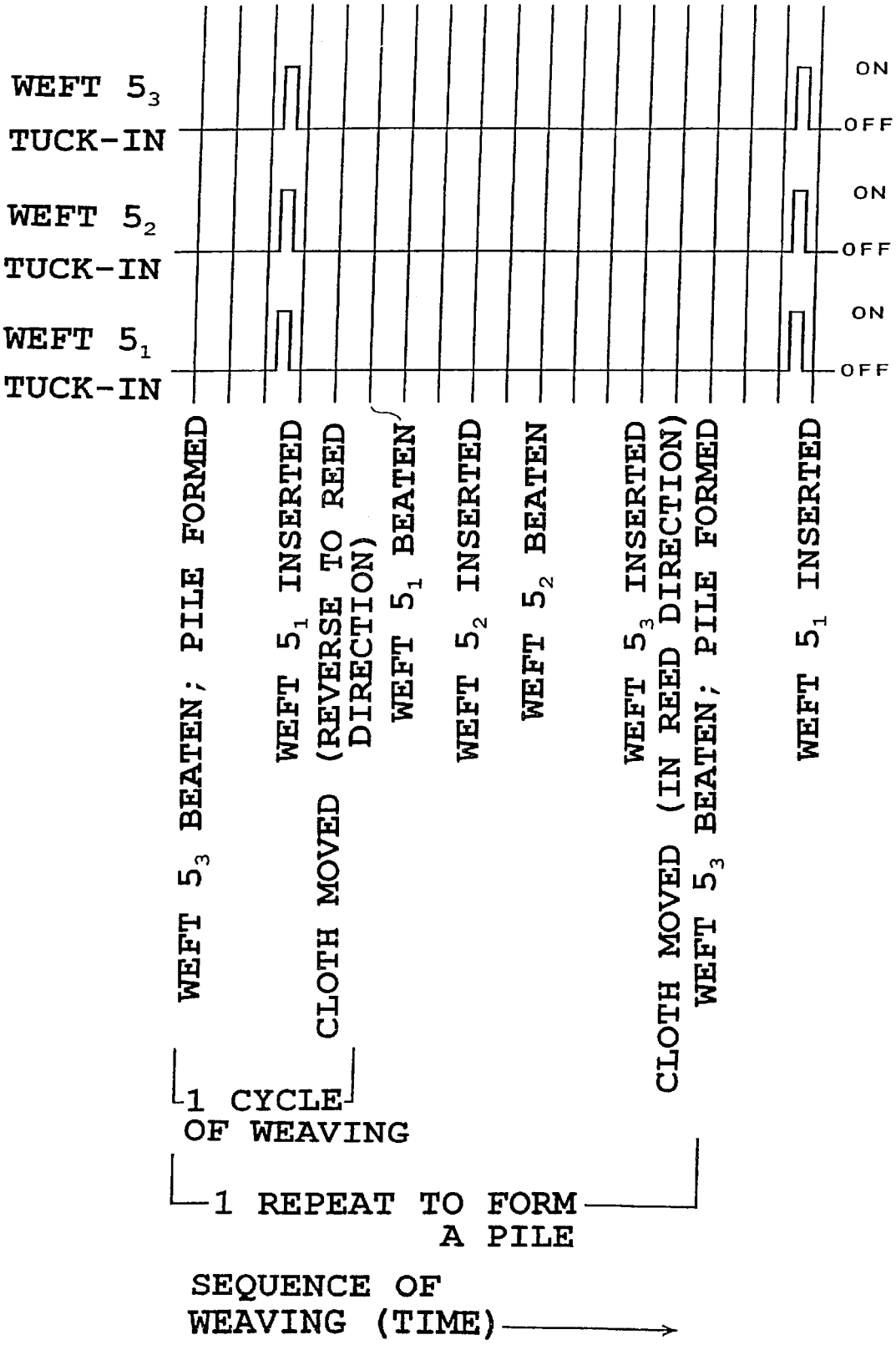
FIG. 5 is a timing chart to indicate the timing of a tuck-in operation of weft in the collective tuck-in method.

Now, a description will be given on the collective tuck-in method with reference to FIG. 4 and FIG. 5. (1) After the first weft $5_1$ has been inserted, the end on the yarn feeding side is cut off by the cutter 12, and the yarn end is sucked by the air and is gripped. (2) At the same time as the insertion of the first weft $5_1$, the cloth is moved in a direction reverse to the reed direction. The first weft $5_1$ is beaten. Then, the second weft $5_2$ is inserted. The end on the yarn feeding side is cut off by the cutter 12, and the yarn end is sucked by the air and is gripped. (3) The second weft $5_2$ is beaten, and then, the third weft $5_3$ is inserted. The end on the yarn feeding side is cut off by the cutter 12, and the yarn end is sucked by the air and is gripped. (4) At the same time as the insertion of the third weft $5_3$, the cloth is moved in the reed direction. Then, it is beaten and a pile fabric is formed. (5) When the crank angle signal reaches the preset value, the tuck-in operation signal is issued from the tuck-in operation command unit 13. The ends on the counter feeding side of these three wefts $5_1$, $5_2$ and $5_3$ are collectively cut off by the cutter 12. Then, by the air flow from the actuator 11, the ends of the wefts $5_1$, $5_2$ and $5_3$ on the yarn feeding side and the counter-feeding side are inserted into the warp opening for the first weft $5_1$ of the next repeat, which begins to open to form the pile fabric. After the insertion, the air flow is stopped. (6) After the first weft $5_1$ has been inserted, the end on yarn feeding side is cut off by the cutter 12, and the yarn end is sucked by the air and is gripped. (7) At the same time as the insertion of the first weft $5_1$, the cloth is moved in a direction reverse to the reed direction. The first weft $5_1$ is beaten, and the tucked fabrics of the three wefts $5_1$, $5_2$ and $5_3$ are formed at the selvedge 8. (8) The above procedure is repeated.

INDUSTRIAL APPLICABILITY

According to a first aspect of the present invention, the tucking operation of the ends of a plurality of wefts inserted in each repeat for the formation of a pile fabric is carried a plurality of times, and at least one tucking operation is performed by bringing the ends of a plurality of wefts together. Compared with the method to tuck in at each weaving cycle of the weft, the number of tuck-in operations can be reduced. As a result, it is possible to increase the number of revolutions of the loom at high speed, to decrease the number of maintenance operations for the tuck-in device, and to decrease electric power consumption due to the reduction in the number of air flow operations. If it is designed in such manner that the ends on counter-feeding side are tucked collectively immediately before the tuck-in operation, it will contribute to a decrease in the number of cutting operations and to the prevention of wear on the cutter. Further, the portions of the tucked fabric inserted into each repeat are dispersed to a plurality of points, and this makes it possible to improve external appearance of the selvedge of the pile fabric compared with the method to collectively tuck all weft ends inserted into each repeat.

According to a second aspect of the present invention, when a cloth is woven, which comprises a portion using thicker wefts and a portion using thinner weft intermingled with each other, a method to tuck in by collectively bringing the ends of as many wefts as inserted into each repeat is adopted for the portion where thinner wefts are used. For the portion where thicker wefts are used, the tuck-in operation of the ends of a plurality of wefts inserted into each repeat is performed a plurality of times, and ends of a plurality of wefts are collectively tucked in at least in one single tuck-in operation. As a result, compared with the method to perform a tuck-in operation for each weaving cycle of the wefts, it is possible to increase the number of revolutions of the loom at high speed, to decrease the number of maintenance operations of the tuck-in device, and to decrease power consumption due to the reduction of the number of the air flow operations. Moreover, compared with the method to collectively tuck all wefts inserted into each repeat, it is possible to improve the external appearance of the selvedges of the pile fabric using thicker wefts.

According to a third aspect of the present invention, in addition to the effects provided by the above first aspect of the invention, it is much easier to set the timing for a tuck-in operation because the tuck-in pattern is the same for the pile fabric and the non-pile fabric.

What is claimed is:

1. A tuck-in selvedge braiding method for a tuck-in device of a shuttleless loom for weaving a towel, comprising the steps of:

inserting a plurality of wefts within one repeat of pile fabric formation; and performing a plurality of tuck-in operations for ends of said plurality of wefts inserted within said one repeat, at least one of said plurality of tuck-in operations other than a last tuck-in operation thereof being performed by bringing ends of a plurality of wefts, whose number is less than a number of said wefts inserted within said one repeat, collectively together, and the last tuck-in operation of said plurality of tuck-in operations being performed in a weaving cycle of a first weft in a next repeat for forming the pile fabric.

2. A tuck-in selvedge braiding method for a tuck-in device of a shuttleless loom for weaving a towel, comprising:

a first series of steps for forming a first kind of pile fabric;

a second series of steps for forming a second kind of pile fabric; and a step of switching over between said first and second series during a series of weaving operations;

said first series including the steps of;

inserting a plurality of wefts within one repeat of pile fabric formation; and performing a plurality of tuck-in operations for ends of said plurality of wefts inserted within said one repeat, at least one of said plurality of tuck-in operations other than a last tuck-in operation thereof being performed by bringing ends of a plurality of wefts, whose number is less than a number of said wefts inserted within said one repeat, collectively together, and the last tuck-in operation of said plurality of tuck-in operations being performed in a weaving cycle of a first weft in a next repeat for forming the pile fabric;

said second series including the steps of;

inserting a plurality of wefts within one repeat of pile fabric formation; and performing a single tuck-in operation for ends of said plurality of wefts inserted within said one repeat, collectively together, said single tuck-in operation being performed in a weaving cycle of a first weft in a next repeat for forming the pile fabric.

3. A tuck-in selvedge braiding method for a tuck-in device of a shuttleless loom for weaving a towel comprising:

a first series of steps for forming pile texture; and a second series of steps for forming non-pile texture;

said first series including the steps of;

inserting a plurality of wefts within one repeat of pile fabric formation; and performing a plurality of tuck-in operations for ends of said plurality of wefts inserted within said one repeat, at least one of said plurality of tuck-in operations other than a last tuck-in operation thereof being performed by bringing ends of a plurality of wefts, whose number is less than a number of said wefts inserted within said one repeat, collectively together, and the last tuck-in operation of said plurality of tuck-in operations being performed in a weaving cycle of a first weft in a next repeat for forming the pile fabric;

said second series including the steps of;

inserting a weft;

performing a single tuck-in operation for an end of said weft inserted; and repeating said inserting step and performing step of said second series so that a predetermined number of said wefts are inserted and the ends of said inserted wefts are tucked-in respectively.

* * * * *